US005467995A

United States Patent [19]

Miller et al.

[11] Patent Number: 5,467,995

[45] Date of Patent: Nov. 21, 1995

[54] MORE CHALLENGING BACKGAMMON TYPE GAME

[76] Inventors: Mark A. Miller, 3099 Minerva Lake Rd., Columbus, Ohio 43231; Ronald H. Miller, 1141 Erie, Bellefontaine, Ohio 43311

[21] Appl. No.: 286,288

[22] Filed: Aug. 5, 1994

[51] Int. Cl.[6] ..... A63F 3/00

[52] U.S. Cl. ..... 273/248

[58] Field of Search ..... 273/243, 242, 273/248, 249

[56] References Cited

U.S. PATENT DOCUMENTS

| | | | |
|---|---|---|---|
| 534,080 | 2/1895 | Preston | 273/248 |
| 3,166,325 | 1/1965 | First | 273/248 X |
| 3,791,648 | 2/1974 | Patterson | 273/248 |
| 4,084,331 | 4/1978 | Nottoli | 273/248 X |
| 4,355,812 | 10/1982 | McCullough | 273/248 |
| 4,549,739 | 10/1985 | Tobin et al. | 273/248 |
| 4,556,221 | 12/1985 | Borland | 273/248 |
| 4,940,242 | 7/1990 | Tingley | 273/248 X |
| 5,269,529 | 12/1993 | Clements | 273/248 X |

FOREIGN PATENT DOCUMENTS

| | | | |
|---|---|---|---|
| 4100951 | 7/1992 | Germany | 273/248 |

*Primary Examiner*—William E. Stoll
*Attorney, Agent, or Firm*—Standley & Gilcrest

[57] ABSTRACT

A game is described which is a modification of the traditional backgammon game. A row of landing zones is placed between the two existing rows and an additional independent roving midman is provided.

8 Claims, 2 Drawing Sheets

MORE CHALLENGING BACKGAMMON TYPE GAME

BACKGROUND AND SUMMARY OF THE INVENTION

The present invention relates generally to games, and more particularly to backgammon style games.

Throughout time man has amused himself by the use of games that allow social interaction while stimulating the mind. Games that require an element of strategy from the players and at the same time provide an element of chance have been extremely popular. Each element ensures that repeated playing will not become predictable and thus monotonous.

Game players continuously endeavor to find variations of familiar games. Backgammon is a very popular and well established game. However, this condition lends itself to a boredom inherent with such familiarity.

The present invention relates to a more challenging backgammon type game that solves the problem of familiarity. The invention takes a substantial portion of the standard backgammon field and rules and adds a third row of landing zones, a bonus die, and an independent roving marker known as a midman. Players are able to move their own individual markers and, in addition, the midman that remains in the center row of landing zones. The additional row extends the time of game play because each player's markers must traverse the middle row in addition to the traditional outer rows. Complexity is increased by the addition of the midman that can bump player markers to the bar, thus causing the bumped marker to start the journey over again and also by the extra roll of the bonus die after every roll of doubles by either player.

DETAILED DESCRIPTION OF PREFERRED EMBODIMENTS

Figure 1:
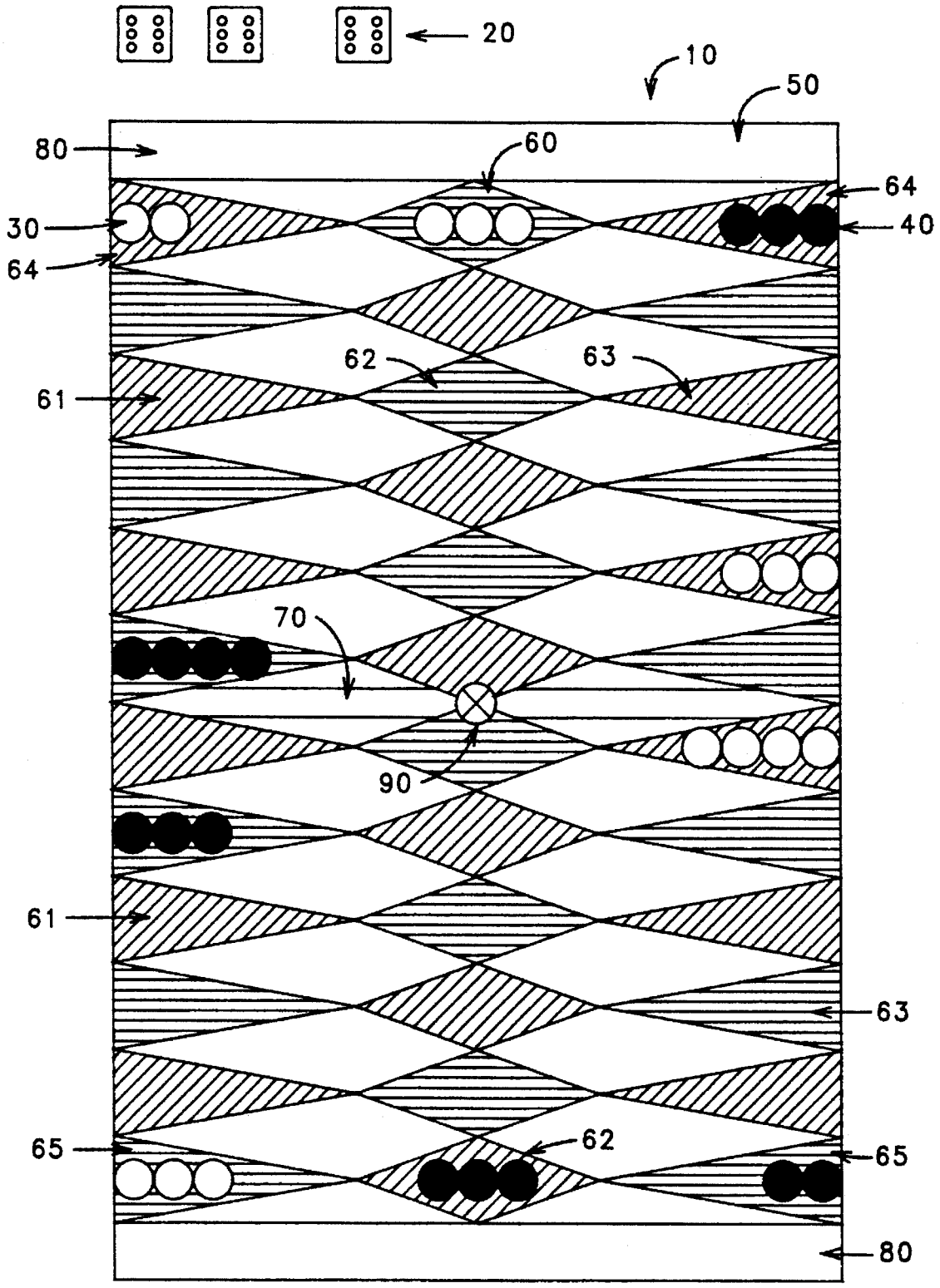
FIG. 1 shows a playing field prior to the start of game play.

Referring now to the drawings, FIG. 1 shows the playing field prior to the start of game play, at 10.

The playing field, 50, is based on a conventional backgammon playing field with the exception of an additional middle row as shown at 60.

Placed on the playing field, 50, is a first set of markers shown generally at 30, a second set of markers shown generally at 40, and a roving midman shown at 90.

A set of six sided dice is shown generally at 20 for use during game play. Another set of dice, one set for each player, may be used to speed up game play.

Each row of landing spaces is more specifically designated as row one shown generally at 61, row two shown generally at 62 and row three shown generally at 63, for the purposes of explanation only. Additionally, columns of landing zones are numbered for purposes of description, starting at column one shown generally at 64 through column twelve shown generally at 65. All markers are preferably placed on the playing field, 50, to start the game, as shown in FIG. 1.

The first set of markers, 30, are placed as follows:

two are positioned in row one column one,
three are positioned in row one column twelve,
three are positioned in row two column one,
three are positioned in row three column five, and
four are positioned in row three column seven.

The second set of markers, 40, are placed as follows:

four are positioned in row one column six,
three are positioned in row one column eight,
three are positioned in row two column twelve,
three are positioned in row three column one, and
two are positioned in row three column twelve.

The playing field may additionally have safety zones, 80. The roving midman, 90, may be placed on a bar, 70, prior to game play.

Game play proceeds in the same manner as traditional backgammon with a few modifications. The first set of markers follows a path designated in a direction of travel from row one column one, to row one column twelve, to row two column twelve, to row two column one, to row three column one, to row three column twelve, and into the safety zone, 80. Therefore, the markers placed at column one, row one have the longest distance to travel of the first set of markers. The second set of markers proceeds in a similar manner but in the opposite direction. Under the traditional rules of backgammon, as well as the present invention, a player's marker may only be bumped from the playing field if it is left on a landing space by itself, and one of the opposing player's markers lands on the landing space occupied by the single marker of the other player. The goal of the game for each player is to position all of his markers in his respective safety zone 80 before the other player.

The roving midman, 90, is independent of the two sets of markers. It is limited in travel to row two. The roving midman may preferably, only be used by each player during his respective turn to bump one of the opposing player's markers from the playing field. The midman is limited in its direction of travel to that direction of travel of the present player's markers while in row two.

Figure 2:
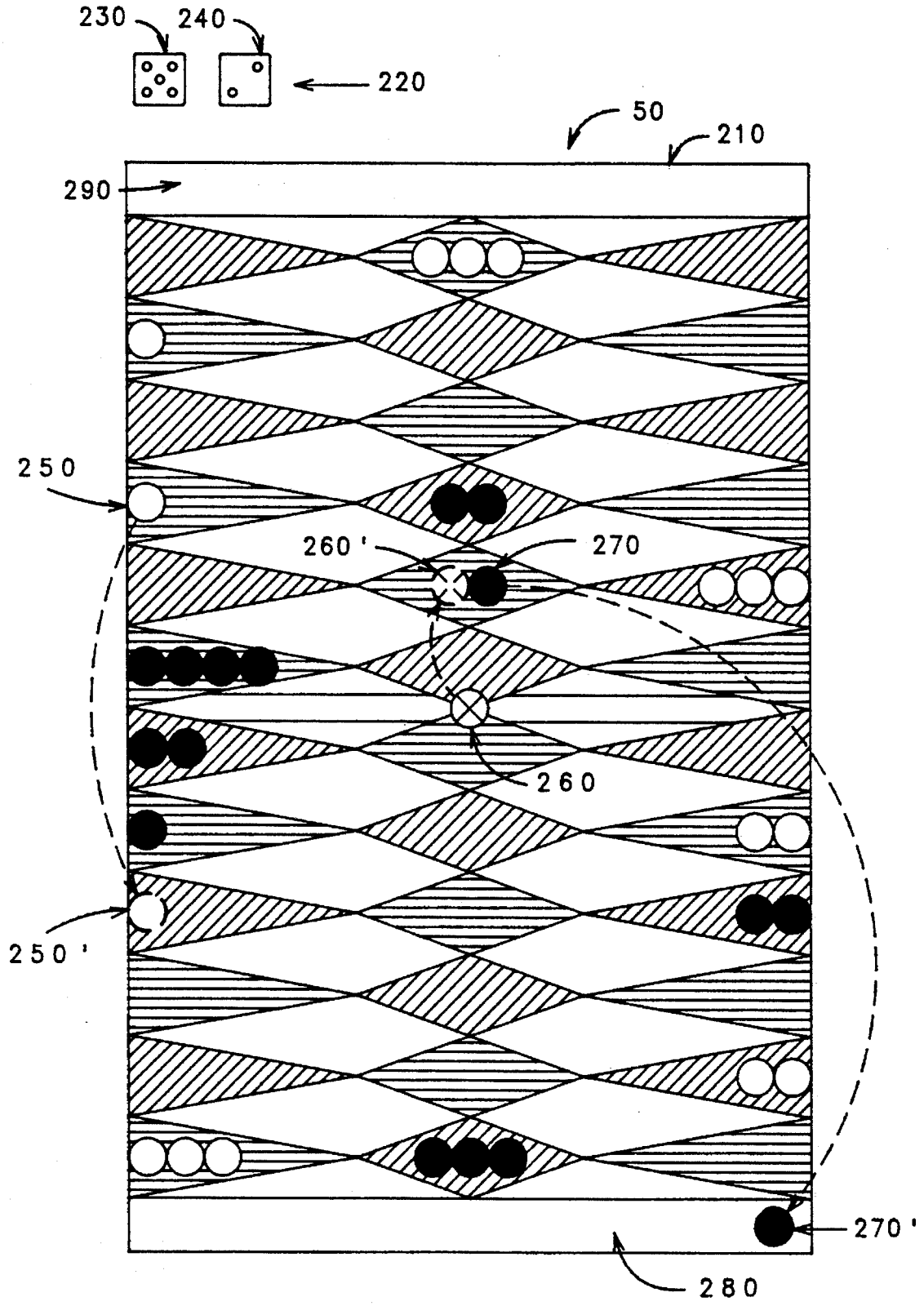
FIG. 2 shows the playing field as may exist during game play.

Referring to FIG. 2, an explanation of a use of the roving midman is demonstrated. The playing field is shown generally at 50 with the substrate indicated at 210. In this example, the player who controls the first set of markers has generated the random numbers, five on the first die 230 and two on the second die 240 as shown at 220. As in traditional backgammon, the player has a choice of moving one marker seven spaces or one marker five spaces and another marker two spaces. The player has the option of moving any of the first set of markers and/or the roving midman, but in no event should the number of cumulative spaces moved in that turn exceed the total number shown on the dice.

In this example, the player chooses to move his marker, indicated at 250, five spaces to 250' and the roving midman, indicated at 260, two spaces to 260'. Moving the roving midman to the position indicated at 260' bumps the second set marker indicated at 270 to the safety zone at 270'. This forces the player controlling the second set of markers to start his bumped piece at the beginning of his path of travel. Note, the roving midman could only move in the direction it did because that is the direction of travel of the first set of markers in row two. The direction of travel for the roving midman for the player controlling the second set of makers would be in the opposite direction.

Game play continues until either player moves all of his controlled markers into his respective safety zone. For the player controlling the first set of markers the goal is to land all of the first set of markers into the safety zone indicated at 280. For the player controlling the second set of markers the safety zone is indicated at 290.

What is claimed is:

1. A method of playing a game on a substrate having a matrix of three rows of twelve landing zones, a safety zone and a bar zone with a first and second set of markers, a roving marker and a random number generator, comprising the steps of:

placing said first set of markers on predetermined landing zones;

placing said second set of markers on predetermined landing zones;

placing said roving marker on said bar;

alternately generating random numbers;

selectively moving a respective first or second marker along a path a number of zones corresponding to at least one of said generated random numbers; and each player at his/her option selectively moving said roving marker a number of zones corresponding to another of said generated random numbers.

2. The method of claim 1 wherein said bar is placed between the sixth and seventh landing zone of the second row of said matrix of landing zones.

3. The method of claim 1 wherein the movement of the roving marker is limited to the second row of said matrix of landing zones.

4. The method of claim 3, wherein the direction of travel for the roving marker is limited to the direction of travel of the respective set of markers on that move.

5. The method of claim 1 wherein the predetermined landing zones for the first set of markers is as follows:

two of said markers are positioned in row one of column one;

three of said markers are positioned in row one of column twelve;

three of said markers are positioned in row two of column one;

three of said markers are positioned in row three of column five; and four of said markers are positioned in row three of column seven.

6. The method of claim 1 wherein the predetermined landing zones for the second set of markers comprises:

four of said markers are positioned in row one of column six;

three of said markers are positioned in row one of column eight;

three of said markers are positioned in row two of column twelve;

three of said markers are positioned in row three of column one; and two of said markers are positioned in row three of column twelve.

7. The method of claim 1 wherein the first set of markers travel in a path starting at column one of row one to column twelve of row one to column twelve of row two to column one of row two to column one of row three to column twelve of row three to said safety zone which abuts column twelve of row three.

8. The method of claim 6 wherein the second set of markers travel in a path starting at column twelve of row three to column one of row three to column one of row two to column twelve of row two to column twelve of row one to column one of row one to safety zone which abuts column one at row one.

* * * * *

UNITED STATES PATENT AND TRADEMARK OFFICE

CERTIFICATE OF CORRECTION

PATENT NO. : 5,467, 995
DATED : November 21, 1993
INVENTOR(S) : Mark A. Miller, et al.

It is certified that error appears in the above-indentified patent and that said Letters Patent is hereby corrected as shown below:

Column 4, line 28, delete "6" and insert --1--.

Signed and Sealed this

Second Day of April, 1996

*Attest:*

*Attesting Officer*

Bruce Lehman

BRUCE LEHMAN

*Commissioner of Patents and Trademarks*